US009523994B2

(12) United States Patent
Cheong et al.

(10) Patent No.: US 9,523,994 B2
(45) Date of Patent: Dec. 20, 2016

(54) TEMPERATURE INSENSITIVE TRANSIENT CURRENT SOURCE

(71) Applicant: STMicroelectronics Asia Pacific Pte. Ltd., Singapore (SG)

(72) Inventors: CheeWeng Cheong, Singapore (SG); Kien Beng Tan, Singapore (SG); Dianbo Guo, Singapore (SG)

(73) Assignee: STMicroelectronics Asia Pacific Pte Ltd, Singapore (SG)

( * ) Notice: Subject to any disclaimer, the term of this patent is extended or adjusted under 35 U.S.C. 154(b) by 186 days.

(21) Appl. No.: 14/201,590

(22) Filed: Mar. 7, 2014

(65) Prior Publication Data

US 2015/0253799 A1 Sep. 10, 2015

(51) Int. Cl.
*G05F 3/26* (2006.01)
*G05F 3/16* (2006.01)

(52) U.S. Cl.
CPC ..... *G05F 3/16* (2013.01); *G05F 3/262* (2013.01)

(58) Field of Classification Search
USPC ..... 323/304, 311–317
See application file for complete search history.

(56) References Cited

U.S. PATENT DOCUMENTS

| | | | | |
|---|---|---|---|---|
| 5,767,708 | A * | 6/1998 | Groeneveld | G06G 7/184 327/103 |
| 6,900,672 | B2 * | 5/2005 | Callahan, Jr. | H03K 4/502 327/108 |
| 8,400,849 | B1 * | 3/2013 | Dornseifer | G11C 5/144 365/145 |
| 2012/0231729 | A1 * | 9/2012 | Xu | G01S 19/21 455/13.4 |

* cited by examiner

*Primary Examiner* — Jeffrey Gblende
(74) *Attorney, Agent, or Firm* — Gardere Wynne Sewell LLP

(57) ABSTRACT

A current source includes a first current path including a first current mirror transistor and an input current source coupled in series, a second current path including a second current minor transistor, wherein control terminals of the first and second current minor transistors are connected, a first circuit configured to provide a controlled auxiliary current in the second current path, and a second circuit configured to provide a controlled output current in the second current path when or after the auxiliary current has reached steady state. The current source may include one or more cascode transistors in the first current path and one or more cascode transistors in the second current path. The first circuit may be activated before the second circuit is activated.

21 Claims, 3 Drawing Sheets

TEMPERATURE INSENSITIVE TRANSIENT CURRENT SOURCE

BACKGROUND

Technical Field

This disclosure relates to electronic circuits and, more particularly, to current sources which produce a transient output current that is insensitive to temperature variations.

Discussion of the Related Art

A current mirror is a type of current source that copies an input current to an output current. The input and output currents can be the same or different, depending on the components of the current minor circuit. The current mirror can provide bias currents or can serve as an active load. A basic current mirror includes two transistors having their gate terminals connected together. As a variation, a cascode current minor includes a cascode transistor connected in series with each of the current mirror transistors. The steady state output current of a cascode current mirror is relatively insensitive to temperature variations.

In some applications, the output current of the cascode current minor is switched on and off. For example, the current minor may be used to discharge a capacitor for a determined discharge period. In such applications, the output of the current mirror is connected through a switch to the capacitor to be discharged. The switch is closed for the discharge period, and the constant current of the current mirror causes the capacitor voltage to decrease linearly. An example of an application is the discharge of the capacitance of a touch screen display in a mobile device.

In certain applications, including but not limited to mobile devices, stable operation of the current source over a range of temperatures is desirable. As noted above, current minors are relatively insensitive to temperature variation in steady state operation. However, when the output current is switched on and off, the operation of the circuit may be sensitive to temperature variations. Accordingly, there is a need for current sources which are relatively insensitive to temperature variations under transient operating conditions.

SUMMARY

The inventors have discovered that temperature sensitivity of the current source under transient conditions results, at least in part, from parasitic capacitances of the current mirror transistor and the cascode transistor. When the output current of the current mirror is turned off, the parasitic capacitances are discharged. When the output switch is closed and the output current is turned on, a portion of the output current charges the parasitic capacitances during a transient period. Thus, the output current is greater than the steady state current of the current mirror during the transient period. The parasitic capacitances are sensitive to temperature variations, thus causing variations in output current as a function of temperature.

In accordance with embodiments, an auxiliary current is supplied to the output of the current mirror so that the parasitic capacitances are charged before the output switch is turned on. Since the parasitic capacitances are charged before the output switch is turned on, charging of the parasitic capacitances does not affect the output current of the current source.

According to one embodiment, a current source comprises a first current path including a first current minor transistor, a first cascode transistor and an input current source coupled in series, a second current path including a second current mirror transistor and a second cascode transistor coupled in series, wherein control terminals of the first and second current minor transistors are connected and wherein control terminals of the first and second cascode transistors are connected, a first circuit coupled to a main terminal of the second cascode transistor and configured to provide a controlled auxiliary current in the second current path, and a second circuit coupled to the main terminal of the second cascode transistor and configured to provide a controlled output current in the second current path when or after the auxiliary current has reached steady state.

In some embodiments, the first circuit comprises a first switch coupled between the main terminal of the second cascode transistor and a voltage.

In some embodiments, the second circuit comprises a second switch coupled between the main terminal of the second cascode transistor and an output.

In some embodiments, the first circuit is activated before the second circuit is activated.

In some embodiments, the second circuit is activated for a fixed discharge period.

In some embodiments, the first circuit is deactivated on or before activation of the second circuit.

In some embodiments, the current source further comprises a controller configured to control activation of the first and second circuits.

In some embodiments, the current source further comprises at least one additional cascode transistor in the first current path and at least one additional cascode transistor in the second current path.

According to another embodiment, a current source comprises a first current path including a first current minor transistor and an input current source coupled in series, a second current path including a second current mirror transistor, wherein control terminals of the first and second current minor transistors are connected, a first circuit configured to provide a controlled auxiliary current in the second current path, and a second circuit configured to provide a controlled output current in the second current path when or after the auxiliary current has reached steady state.

According to a further embodiment, a method is provided for operating a current source that comprises a first current path including a first current minor transistor, a first cascode transistor and an input current source coupled in series, and a second current path including a second current mirror transistor and a second cascode transistor coupled in series, the method comprising providing a controlled auxiliary current in the second current path, and providing a controlled output current in the second current path when or after the auxiliary current has reached steady state.

BRIEF DESCRIPTION OF THE DRAWINGS

For a better understanding of the embodiments, reference is made to the accompanying drawings, which are incorporated herein by reference and in which.

DETAILED DESCRIPTION

Figure 1:
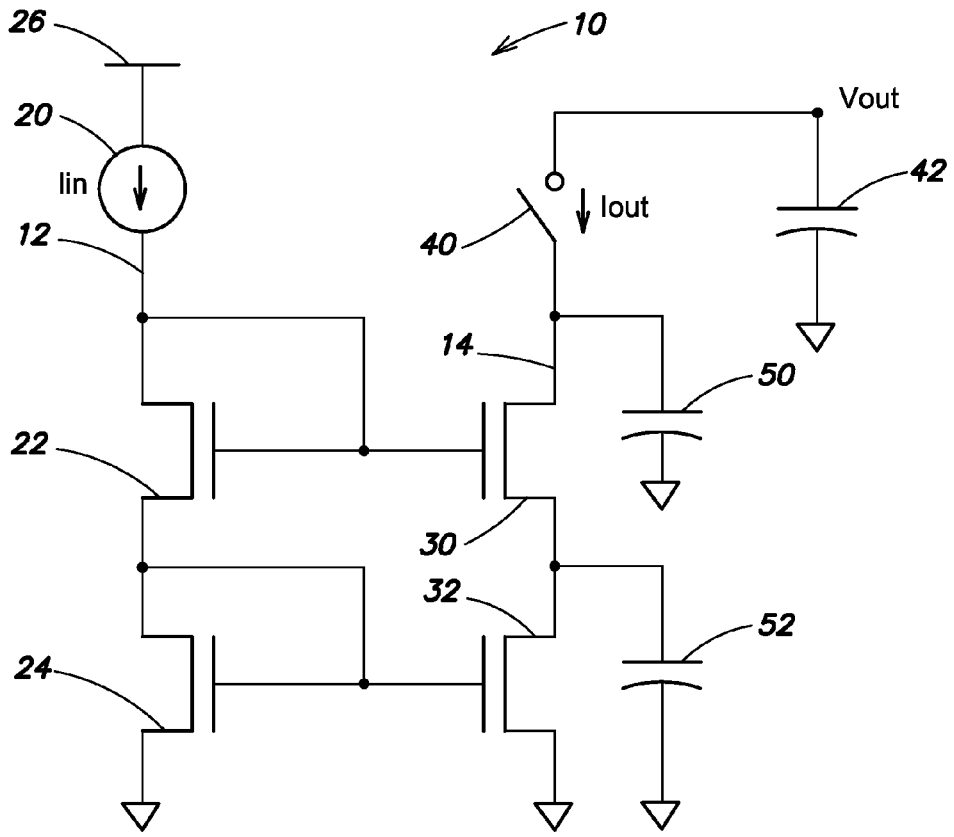
FIG. 1 is a schematic diagram of a current minor used to discharge a capacitor.

A schematic diagram of a current source configured to discharge a capacitor is shown in FIG. 1. A current source 10 is configured as a cascode current mirror current source. The current source 10 has a first current path 12 and a second current path 14. The first current path includes an input current source 20, a first cascode transistor 22 and a first current minor transistor 24 connected in series between a supply voltage 26 and ground. The input current source 20 supplies an input current Iin. The gate and drain terminals of first cascode transistor 22 are connected together, and the gate and drain terminals of first current mirror transistor 24 are connected together. The second current path 14 includes a second cascode transistor 30 and a second current minor transistor 32 connected in series between an output and ground. The gate terminals of the first cascode transistor 22 and the second cascode transistor 30 are connected together, and the gate terminals of the first current minor transistor 24 and the second current mirror transistor 32 are connected together. The drain terminal of second cascode transistor 30 is connected through a switch 40 to a load in the form of a capacitor 42. If the transistors 22, 24, 30 and 32 of the current source have matching characteristics, the input current Iin is copied to an output current Iout.

Figure 2:
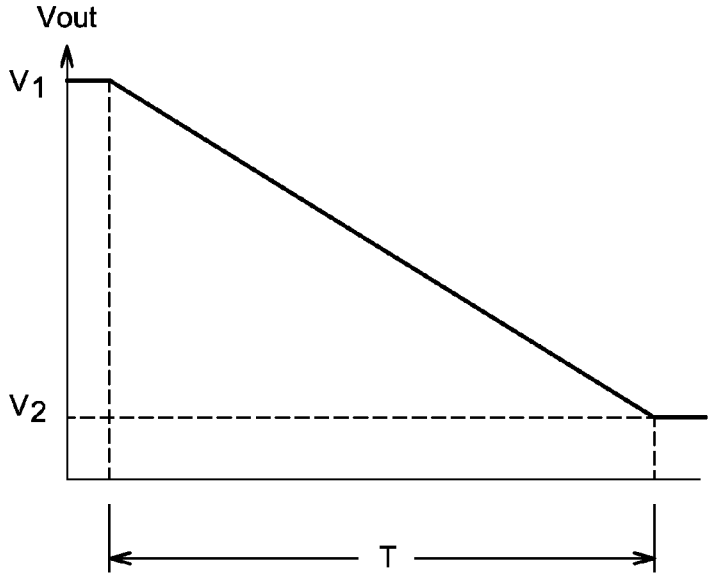
FIG. 2 is a graph of capacitor voltage as a function of time in the circuit of FIG. 1.

Operation of the circuit of FIG. 1 is described with reference to FIG. 2. In FIG. 2, the output voltage Vout on capacitor 42 is plotted as a function of time. The capacitor 42 is charged to an initial voltage $V_1$ from a source (not shown). The capacitor 42 is discharged for a discharge time T by closing switch 40. During the discharge time T, the voltage Vout on capacitor 42 decreases linearly due to the constant output current Iout of current source 10. A final voltage $V_2$ is a function of the initial voltage $V_1$, the current Iin provided by input current source 20, the discharge time T and any current that charges parasitic capacitances of the current source.

As further shown in FIG. 1, the second cascode transistor 30 has a parasitic capacitance 50 and the second current mirror transistor 32 has a parasitic capacitance 52. While parasitic capacitances 50 and 52 are shown in FIG. 1 as separate elements, it will be understood that the parasitic capacitances are characteristics of the respective transistors rather than separate elements. When the switch 40 is open, the output current Tout of the current source 10 is zero and parasitic capacitances 50 and 52 are discharged. During an initial period after switch 40 is closed, the output current Tout is a function of input current Iin and the current required to charge parasitic capacitances 50 and 52. The parasitic capacitances 50 and 52 are sensitive to temperature and, as a result, the output current Tout is sensitive to temperature during the initial period following the closure of switch 40. Thus, the current source 10 shown in FIG. 1 has an output current that is sensitive to temperature under transient operating conditions.

Figure 3:
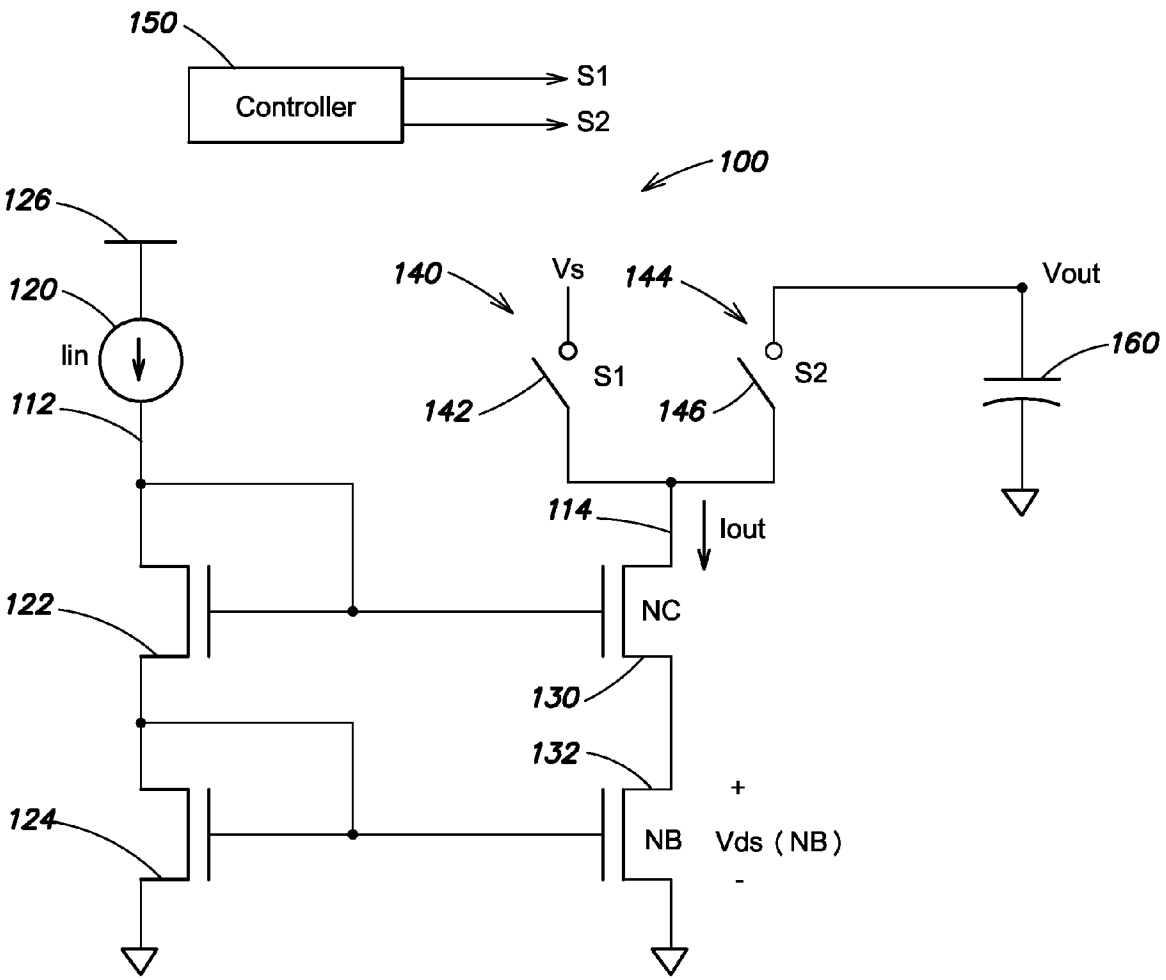
FIG. 3 is a schematic diagram of a current source used to discharge a capacitor, in accordance with embodiments.

A current source 100 in accordance with embodiments is shown in FIG. 3. The current source 100 includes a first current path 112 and a second current path 114. The first current path 112 includes an input current source 120, a first cascode transistor 122 and a first current minor transistor 124 connected in series between a supply voltage 126 and ground. The input current source 120 supplies an input current Iin. The second current path 114 includes a second cascode transistor 130 and a second current mirror transistor 132 connected in series. The drain terminal and the gate terminal of first cascode transistor 122 are connected together, and the drain terminal and the gate terminal of first current mirror transistor 124 are connected together. Further, the gates of the cascode transistors 122 and 130 are connected together, and the gates of current minor transistors 124 and 132 are connected together. Each of the transistors has a control terminal (gate terminal) and two main terminals (source and drain terminals).

The current source of FIG. 3 further includes a first circuit 140 coupled to a drain terminal of the second cascode transistor 130 and configured to provide a controllable auxiliary current in the second current path 114. In the embodiment of FIG. 3, the first circuit 140 comprises a first switch 142 coupled between the drain terminal of second cascode transistor 130 and a reference voltage source Vs. In some embodiments, voltage source Vs is the same as supply voltage 126. The current source further comprises a second circuit 144 coupled to the drain terminal of the second cascode transistor 130 and configured to provide an output current in the second current path. In the embodiment of FIG. 3, the second circuit 144 comprises a second switch 146 coupled between the drain terminal of second cascode transistor 130 and an output of the current source. The first and second switches 142 and 146 may be controllable in response to control signals provided by a controller 150. For example, switches 142 and 146 may comprise transistor switches. The current source 100 of FIG. 3 discharges a capacitor 160 connected to the output of the current source. It will be understood that the current source 100 can be used in different applications and is not limited to discharging a capacitor.

The current source 100 of FIG. 3 has a cascode current mirror configuration. In particular, the output current Iout is equal to the input current Iin for the case where the transistors of the current paths 112 and 114 have matching sizes and characteristics. In other embodiments, the output current Iout can be scaled relative to the input current Iin by appropriate scaling of the cascode transistors 122 and 130 and the current mirror transistors 124 and 132.

Figure 4:
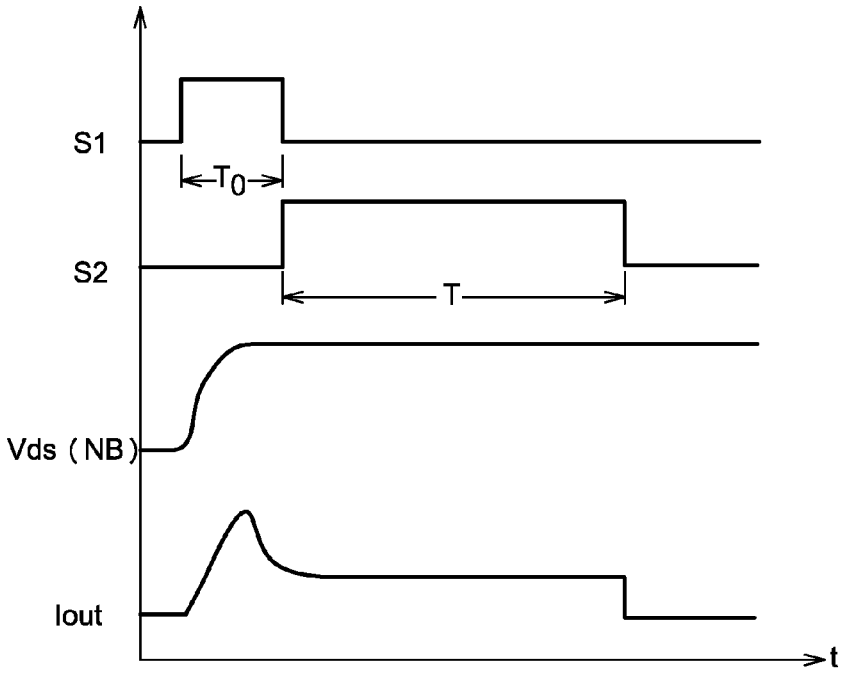
FIG. 4 is a graph of waveforms in the circuit of FIG. 3 as a function of time.

The operation of the current source 100 of FIG. 3 is described with reference to the timing diagram of FIG. 4. As shown in FIG. 4, first switch S1 is closed during a precharging period To before second switch S2 is closed. During the precharging period To when first switch S1 is closed, current flows through the second current path 114 and a drain-source voltage Vds is established across second current minor transistor 132. The drain-source voltage Vds of second current minor transistor 132 increases from zero to a steady state value. The output current Iout also increases due at least in part to charging of the parasitic capacitances of transistors 130 and 132 and then stabilizes at a steady state value.

When the voltage and current of the second current path 114 have stabilized, the first switch S1 is opened, and the second switch S2 is closed, so that the output current Iout flows from capacitor 160 through the second current path 114 of the current source 100. As shown in FIG. 4, the drain-source voltage Vds of current minor transistor 132 and the output current Iout are constant during the time that second switch S2 is closed. Further, since the parasitic capacitances of transistors 130 and 132 were charged during the precharging period To, the output current Iout during the discharge period T is a function of input current Iin, but is not affected by the parasitic capacitances. Thus, the temperature sensitivity of the parasitic capacitances of transistors 130 and 132 does not affect operation of the current source.

As shown in FIG. 4, the first switch S1 may be opened when or slightly before the second switch S2 is closed. Preferably the time between the opening of switch S1 and the closing of switch S2 is short to limit discharge of the parasitic capacitances. Switches S1 and S2 should not be closed at the same time. The switch S2 is closed for the discharge period T as described above. The cycle shown in FIG. 4 and described above can be repeated at intervals, such as, for example, intervals of 2 milliseconds. In some embodiments, first switch S1 may be closed for a precharging period To of about 0.4 microsecond. It will be understood that these values are given by way of example only and are not limiting. The precharging period To should be sufficient to reach steady state operation, while providing a margin of error for component and temperature variations, but is preferably limited in duration in order to avoid unnecessary power consumption.

The embodiment of FIG. 3 is a cascode current source with a cascode transistor coupled in series with each current minor transistor. In further embodiments, the current source may include additional cascode transistors. For example, with reference to FIG. 3, two or more cascode transistors may be connected in series with first current minor transistor 124 and two or more cascode transistors may be connected in series with second current minor transistor 132. In each case, the number of cascode transistors in each current path 112, 114 is equal.

Figure 5:
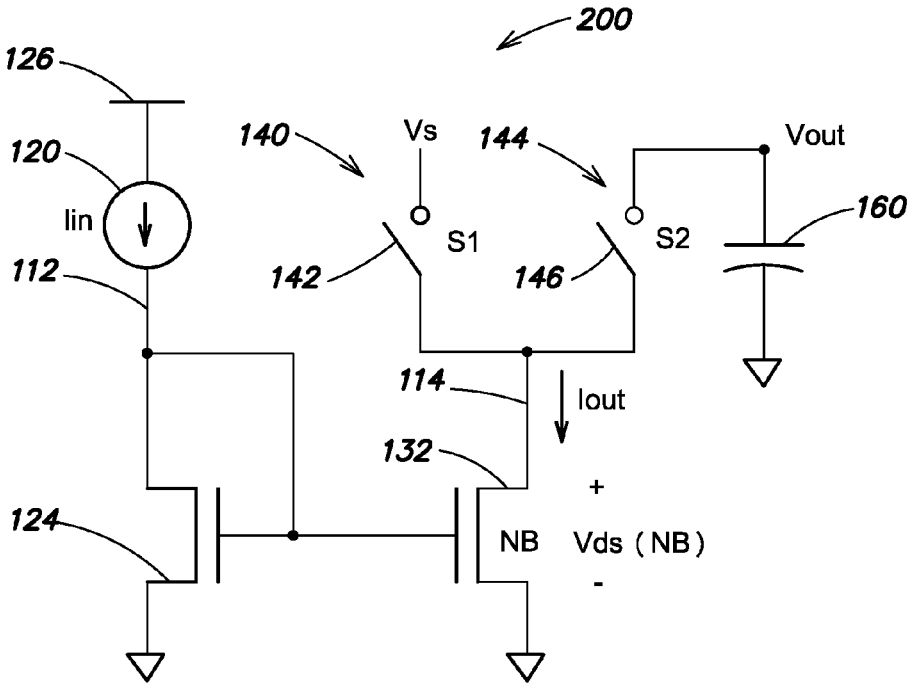
FIG. 5 is a schematic diagram of a current source used to discharge a capacitor, in accordance with additional embodiments.

A current source 200 having a non-cascode current minor configuration is shown in FIG. 5. Like elements in FIGS. 3 and 5 have the same reference numerals, and their descriptions will not be repeated. The current source 200 of FIG. 5 differs from the current source 100 of FIG. 3 in that the cascode transistors 122 and 130 of FIG. 3 are omitted in the current source of FIG. 5. Thus, the first current path 112 includes input current source 120 and first current minor transistor 124 connected in series. The second current path 114 includes second current mirror transistor 132, and the first switch 142 and the second switch 146 are connected to the drain terminal of second current mirror transistor 132. The current source 200 of FIG. 5 operates as described above in connection with FIG. 4.

Having thus described at least one illustrative embodiment of the invention, various alterations, modifications and improvements will readily occur to those skilled in the art. Such alterations, modifications, and improvements are intended to be part of this disclosure, and are intended to be within the spirit and the scope of the present invention.

Accordingly, the foregoing description is by way of example only and is not intended to be limiting. The present invention is limited only as defined in the following claims and the equivalents thereto.

What is claimed is:

1. A current source comprising:

a first current path including a first current mirror transistor, a first cascode transistor and an input current source coupled in series;

a second current path including a second current mirror transistor and a second cascode transistor coupled in series, wherein a control terminal of the first current mirror transistor is connected to a control terminal of the second current mirror transistor and wherein a control terminal of the first cascode transistor is connected to a control terminal of the second cascode transistor;

a first circuit coupled to a main terminal of the second cascode transistor and configured to provide an auxiliary current in the second current path during a first time period but not during a second time period; and a second circuit coupled to the main terminal of the second cascode transistor and configured to disconnect the second current path from a output node coupled to a load during the first time period and connect the second current path to the output node and load during the second time period to provide an output current to discharge the load.

2. A current source as defined in claim 1, wherein the first circuit comprises a first switch coupled between the main terminal of the second cascode transistor and a voltage.

3. A current source as defined in claim 2, wherein the second circuit comprises a second switch coupled between the main terminal of the second cascode transistor and the output node.

4. A current source as defined in claim 1, wherein the first circuit is activated during the first time period before the second circuit is activated during the second time period.

5. A current source as defined in claim 4, wherein the second circuit is activated for a fixed discharge period during the second time period.

6. A current source as defined in claim 4, wherein the first circuit is deactivated during the second time period.

7. A current source as defined in claim 1, further comprising a controller configured to control activation of the first and second circuits.

8. A current source comprising:

a first current path including a first current mirror transistor and an input current source coupled in series;

a second current path including a second current mirror transistor, wherein control terminals of the first and second current mirror transistors are connected;

a first circuit configured to provide an auxiliary current in the second current path during a first time period but not during a second time period; and a second circuit configured to couple the second current path to an output node coupled to a capacitive load during the second time period but not during the first time period to provide an output current in the second current path.

9. A current source as defined in claim 8, wherein the first and second circuits are coupled to a main terminal of the second current mirror transistor.

10. A current source as defined in claim 8, wherein the first circuit comprises a first switch coupled between the second current mirror transistor and a voltage, said first switch closed during the first time period.

11. A current source as defined in claim 10, wherein the second circuit comprises a second switch coupled between the second current mirror transistor and the output node, said second switch closed during the second time period.

12. A current source as defined in claim 8, wherein the first circuit is activated during the first time period prior to the second circuit being activated during the second time period.

13. A current source as defined in claim 12, wherein the second circuit is activated during the second time period for a fixed discharge period.

14. A current source as defined in claim 12, wherein the first circuit is deactivated during the second time period after the auxiliary current has reached steady state.

15. A current source as defined in claim 8, further comprising a controller configured to control activation of the first and second circuits.

16. A method for operating a current source that comprises a first current path including a first current mirror transistor, a first cascode transistor and an input current source coupled in series, and a second current path including a second current mirror transistor and a second cascode transistor coupled in series, the method comprising:

providing an auxiliary current in the second current path during a first time period but not during a second time period in order to charge parasitic capacitances of the second current mirror transistor and second cascode transistor; and providing an output current in the second current path to discharge current from an output node and load coupled to the second current path during the second time period but not during the first time period.

17. A method as defined in claim 16, wherein the output current is supplied for a fixed discharge period during the second time period.

18. A method as defined in claim 16, wherein the auxiliary current is deactivated during the second time period.

19. A method as defined in claim 16, wherein the first time period is long enough to allow the auxiliary current to reach steady state.

20. A current source as defined in claim 1, wherein the first time period is long enough to allow the auxiliary current to reach steady state.

21. A current source comprising:

a first current path including a first current mirror transistor and an input current source coupled in series;

a second current path including a second current mirror transistor, wherein control terminals of the first and second current mirror transistors are connected;

a first circuit configured to provide a controlled auxiliary current in the second current path during a first time period but not during a second time period; and a second circuit configured to provide a controlled output current in the second current path during the second time period but not during the first time period;

wherein the first time period is prior to the second time period; and wherein the first circuit is deactivated during the second time period after the controlled auxiliary current has reached steady state.

* * * * *